US005148867A

United States Patent [19]

Coyle

[11] Patent Number: 5,148,867

[45] Date of Patent: Sep. 22, 1992

[54] STOP FOR AN OIL WELL SWABBING DEVICE

[75] Inventor: Gary W. Coyle, Caldwell, Ohio

[73] Assignee: Concoyle Oil Fields Tools, Inc., Salt Lake City, Utah

[21] Appl. No.: 716,147

[22] Filed: Jun. 17, 1991

[51] Int. Cl.[5] ..... E21B 23/02

[52] U.S. Cl. ..... 166/213; 166/241.1

[58] Field of Search ..... 166/206, 213, 111, 214, 166/215, 216, 241, 242, 243, 136; 294/86.24, 93, 97

[56] References Cited

U.S. PATENT DOCUMENTS

| | | | |
|---|---|---|---|
| 166,206 | 11/1913 | Baker . | |
| 1,503,693 | 8/1924 | McLean . | |
| 2,001,012 | 5/1935 | Burgher | 103/52 |
| 2,878,754 | 3/1959 | McMurry | 103/52 |
| 2,884,071 | 4/1959 | Fredd | 166/17 |
| 2,942,666 | 6/1960 | True et al. | 166/135 |
| 2,991,835 | 7/1961 | Schwab | 166/214 |
| 3,064,737 | 11/1962 | Quinn | 166/214 |
| 3,102,594 | 9/1963 | Crowe | 166/125 |
| 3,179,022 | 4/1965 | Bloudoff | 92/252 |
| 3,812,911 | 5/1974 | Vann | 166/135 |
| 4,070,134 | 1/1978 | Gramling | 417/36 |
| 4,113,010 | 9/1978 | Gramling | 166/213 |
| 4,405,017 | 9/1983 | Allen et al. | 166/382 |
| 4,518,037 | 5/1985 | Youngblood et al. | 166/125 |
| 4,528,896 | 7/1985 | Edwards | 92/242 |
| 4,813,485 | 3/1989 | Coyle | 166/372 |
| 4,898,239 | 2/1990 | Rosenthal | 166/133 |

*Primary Examiner*—Terry Lee Melius
*Attorney, Agent, or Firm*—John L. Gray

[57] ABSTRACT

A stop for an oil well swabbing device which is economical to use, is readily positioned in the well casing at the desired level, and is readily removable with a conventional fishing tool.

3 Claims, 2 Drawing Sheets

STOP FOR AN OIL WELL SWABBING DEVICE

BACKGROUND OF THE INVENTION

Gas and oil well pumping or swabbing devices to remove oil from an oil and gas well relying on the residual gas pressure in the well to lift the swabbing device and the attendant column of oil thereabove in said oil well casing are exemplified by U.S. Pat. Nos. 4,813,485, Coyle, 4,528,896, Edwards, 4,070,134, Gramling, and 3,179,022, Bloudoff, as well as others. Many of these devices contain a valve which, when open, permits the inherent weight of the swabbing device to cause it to sink down within the oil well casing through the accumulated oil and gas therein to a predetermined position near the bottom of the casing, at which time a stop or a pressure sensor will cause the valve to be closed, and as gas pressure builds up underneath the swabbing device, it and the column of oil thereabove will be raised to the surface, at which time the valve will again be opened, either automatically or manually, and the swabbing device will repeat the cycle.

There are a number of stops for actuating the valve in the swabbing device disclosed in the prior art, some of which are retrievable. However, many are not. Examples of these stops are U.S. Pat. Nos. 3,102,594, Crowe, 3,812,911, Vann, 4,113,010, Gramling, 4,405,017, Allen, et al., and others.

In the extremely low yield oil wells in which these pumping devices are used, the removable stops are, for the most part, expensive and complicated, and the ones that are economically attractive for such use remain in the well, which is undesirable.

SUMMARY OF THE INVENTION

Applicant has developed a stop for an oil well swabbing device which is economical to use and is readily positioned in the well casing at the desired level and is readily removable with a conventional fishing tool which usually involves the bending of a few frangible fingers on the device which may be readily and economically repaired.

It is therefore an object of this invention to provide a stop for an oil well swabbing device that is simple in construction and which can be sold at a price that is economically attractive for the conditions in which it will be used.

It is a further object of this invention to provide such a stop which may be readily and easily positioned in an oil well casing at the proper location in the casing.

It is a further object of this invention to provide such a stop which may be readily removed from an oil well casing using a conventional fishing tool.

These, together with other objects and advantages of the invention will become more readily apparent to those skilled in the art when the following general statements and descriptions are read in the light of the appended drawings.

DETAILED DESCRIPTION OF THE DRAWINGS

Figure 1:
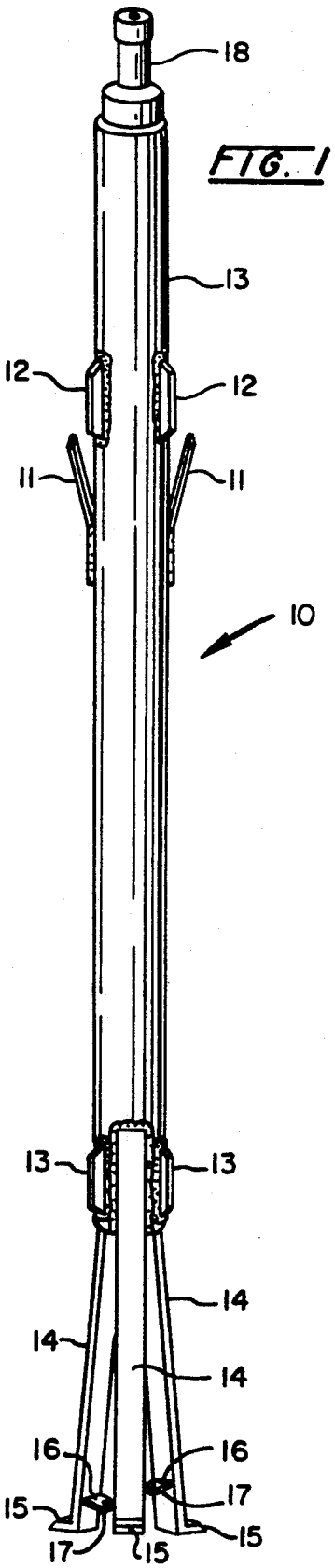
FIG. 1 is a perspective view of applicant's invention.

Referring now more particularly to FIG. 1, applicant's stop is shown generally as a long, slender, cylindrical device 10 provided with a plurality of upwardly extending fingers 11-11 and having outwardly extending spacers 12-12 which are used to center applicant's cylindrical member 13 in the well casing. The finger members 11-11 are welded to the cylindrical member 13 but they are of a size and shape that when sufficient upward pressure is placed on them in connection with the removal of the cylindrical member 13 from the oil well casing they will bend to allow retrieval and they may be readily repaired if they are bent during extraction. Extending downwardly from the cylindrical member 13 are three supports 14-14, each provided with outwardly extending feet 15-15 and tabs 16-16, each tab containing a hole 17. The cylindrical member 13 is provided with a fixture 18 at the top thereof which is adapted to be engaged by a conventional fishing tool.

Figure 2:
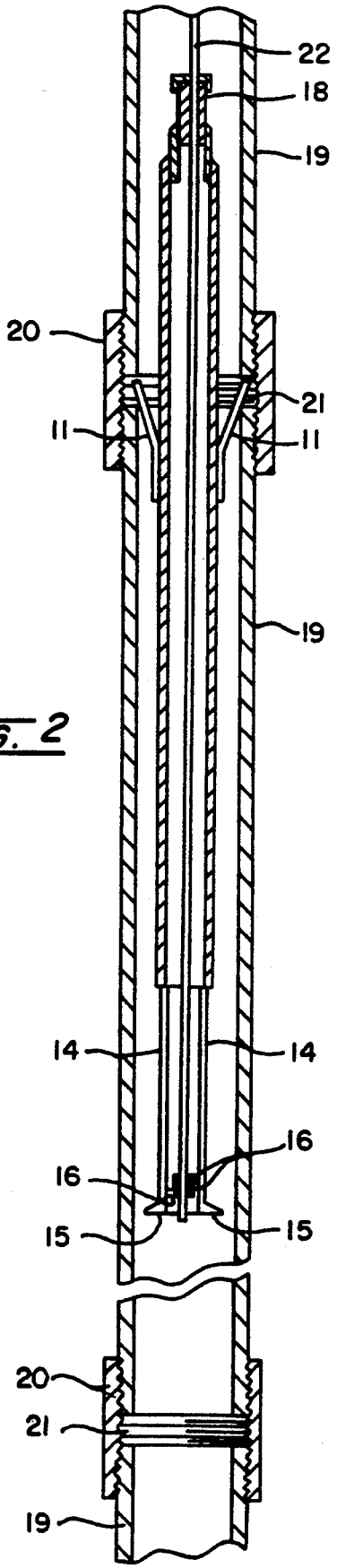
FIG. 2 is a side elevation sectional view of applicant's invention showing it positioned within an oil well preparatory to being set in the oil well casing.

Referring now more particularly to FIG. 2, applicant's stop is shown positioned in a typical oil well casing provided with casing sections 19-19 threadedly connected together by sleeves or collars 20-20. In practice, the casing sections 19-19 when engaging the sleeves 20-20 do not touch each other but leave a small space 21-21 therebetween. The cylindrical member 13 is hollow so that a rod 22 may extend therethrough and also through the holes 17-17 in tabs 16-16 thus holding supports 14-14 together and keeping feet 15-15 from engaging the oil well casing sections 19-19 at the spaces 21-21.

Figure 3:
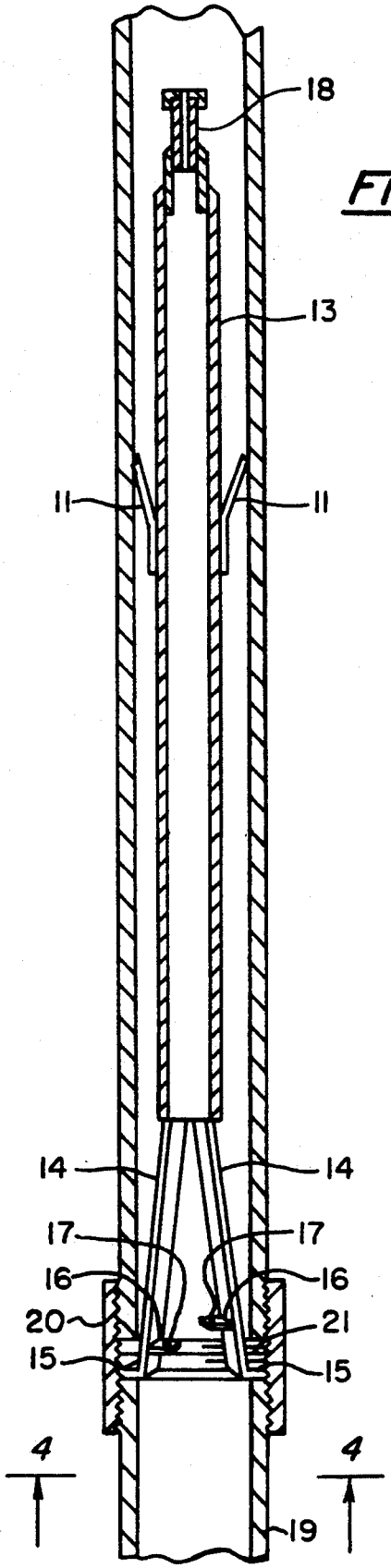
FIG. 3 is a side elevation sectional view of applicant's invention showing said stop positioned in said oil well casing so that it can function to actuate the valve in an oil well swabbing device.
Figure 4:
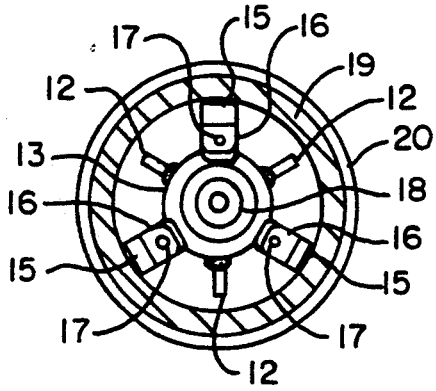
FIG. 4 is a sectional view of the stop in the oil well casing on section 4—4 of FIG. 3.

As the cylindrical member 13 is lowered down by an appropriate cable (not shown) attached to the top of rod 22, fingers 11-11 which are normally biased outwardly from the cylindrical member 13 will slide past openings 21-21 until the proper depth is achieved. At joint 21, just above the desired positioning of cylindrical member 13, the cable (not shown) which is attached to the rod 22 will be pulled upwardly. Fingers 11-11 will engage the underside of a section of casing 19 in space 21-21 selected and further upward pull on the rod 22 will result in its removal from the cylindrical member 13. The frictional engagement of the rod 22 with the holes 17-17 in tabs 16-16 is sufficient to keep the rod and the cylindrical member 13 engaged as the cylindrical member 13 is being lowered down through the well casing. Once the rod is pulled upward, however, the cylindrical member 13 is held from upward movement by means of fingers 11-11 engaging the lower end of a casing section 19 at the space 21 and the feet 15-15 are then free to extend outwardly. Cylindrical member 13 then will move downward as a result of contact with the swabbing unit as it runs and the feet 15-15 will engage the top of the next section of oil well casing 19 in space 21 as shown in FIG. 3, thus permitting the fixture 18 to actuate a valve in a swabbing device when it comes to rest on fixture 18, prior to its ascent performing a pumping action. Fixture 18 is also in position for ultimate retrieval of the stop 10 by a fishing tool. Fingers 11-11 will be bent downward during such retrieval operation, but may be readily repaired. The stop shown in FIG. 3 is also shown in section 4-4 of FIG. 3 in FIG. 4.

Thus, it will be seen that applicant has invented a stop for an oil well swabbing device which is simple to operate, economic to use, and which may be readily removed from the oil well casing with a conventional fishing tool after it has performed its function.

While this invention has been described in its preferred embodiment, it is to be appreciated that variations therefrom may be made without departing from the true scope and spirit of the invention.

What is claimed:

1. A stop for an oil well swabbing device, said stop comprising, a cylindrical member of a diameter smaller than the interior diameter of the oil well casing in which said stop is to be used, a plurality of outwardly biased finger members attached to said cylindrical member adjacent to the upper end thereof and upwardly extending when said cylindrical member is placed in an oil well casing and adapted to engage the lower end of a section of oil well casing pipe at a joint with another section of oil well casing pipe and adapted to resist upward movement of said cylindrical member in an oil well casing, said finger members being of a size and shape such that they will bend downward along said cylindrical member when sufficient upward force is exerted on said cylindrical member, thus permitting said cylindrical member to be removed from said oil well casing, a plurality of outwardly extending supports connected to and extending downwardly from the lower end of said cylindrical member when said cylindrical member is placed in an oil well casing and normally biased outwardly from said cylindrical member, said supports being provided with means to engage the upper end of a section of oil well casing pipe at a joint with another section of oil well casing pipe and support said cylindrical member in said oil well casing, said cylindrical member being provided with a hollow coaxial portion extending completely therethrough and adapted to receive a rod therein of a length such that said rod will extend beyond the upper and lower ends of said cylindrical member, means on said supports adapted to permit said supports to be held by the lower end of said rod while said rod is positioned inside said cylindrical member, and means on the upper end of said rod adapted to engage means for lowering said rod and said cylindrical member into said oil well casing.

2. The device of claim 1 wherein said cylindrical member is provided with means to center it in said oil well casing.

3. The device of claim 1 wherein said cylindrical member is provided with means at the upper end thereof to engage a conventional oil well fishing tool.

* * * * *